US008585041B2

(12) United States Patent
Okutsu et al.

(10) Patent No.: US 8,585,041 B2
(45) Date of Patent: Nov. 19, 2013

(54) RECORDING MEDIUM SUPPLYING DEVICE AND IMAGE FORMING APPARATUS WITH PRESSING FORCE VARYING MECHANISM

(71) Applicants: Toshihiro Okutsu, Miyagi (JP); Munehisa Fuda, Miyagi (JP); Hideyuki Satoh, Miyagi (JP); Taewon Kim, Miyagi (JP)

(72) Inventors: Toshihiro Okutsu, Miyagi (JP); Munehisa Fuda, Miyagi (JP); Hideyuki Satoh, Miyagi (JP); Taewon Kim, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/664,916

(22) Filed: Oct. 31, 2012

(65) Prior Publication Data

US 2013/0106045 A1 May 2, 2013

(30) Foreign Application Priority Data

Nov. 2, 2011 (JP) ..... 2011-241111

(51) Int. Cl.
*B65H 7/02* (2006.01)
*B65H 1/18* (2006.01)

(52) U.S. Cl.
CPC ..... *B65H 1/18* (2013.01)
USPC ..... 271/31

(58) Field of Classification Search
USPC ..... 271/25, 130
See application file for complete search history.

(56) References Cited

U.S. PATENT DOCUMENTS 2,267,784 A * 12/1941 Belluche ..... 271/38
2,615,713 A * 10/1952 Backhouse ..... 271/98
5,447,301 A * 9/1995 Renner ..... 271/31
2006/0012107 A1 1/2006 Ueda et al.
2008/0297580 A1 12/2008 Fukumoto et al.
2009/0057990 A1 3/2009 Ueda et al.
2010/0148430 A1 6/2010 Fuda
2010/0164165 A1 7/2010 Ueda et al.
2011/0148027 A1 6/2011 Fuda
2011/0187042 A1* 8/2011 Fuda ..... 271/12
2011/0187044 A1 8/2011 Utagawa et al.
2011/0193284 A1 8/2011 Fuda
2011/0221119 A1 9/2011 Fuda
2012/0133092 A1 5/2012 Fuda et al.

FOREIGN PATENT DOCUMENTS

JP 2001-247229 9/2001
JP 2007-045630 2/2007
JP 2011-046457 3/2011
JP 2011-073864 4/2011
JP 2011073864 A * 4/2011

* cited by examiner

*Primary Examiner* — Gerald McClain
(74) *Attorney, Agent, or Firm* — Harness, Dickey & Pierce P.L.C.

(57) ABSTRACT

A recording medium supplying device includes a recording medium mounting portion on which sheet-like recording media are capable of being mounted in a stacked state, an air discharging unit that blows air to the recording media in the stacked state so as to make recording medium at an uppermost position float, a conveying unit that adsorbs and conveys the floating recording medium at the uppermost position, an upper surface position detecting unit that makes contact with an uppermost surface of the recording media in the stacked state and detects a height position of the uppermost surface, and a pressing force varying mechanism that makes a pressing force of the upper surface position detecting unit on the uppermost surface of the recording media variable.

8 Claims, 9 Drawing Sheets

RECORDING MEDIUM SUPPLYING DEVICE AND IMAGE FORMING APPARATUS WITH PRESSING FORCE VARYING MECHANISM

CROSS-REFERENCE TO RELATED APPLICATIONS

The present application claims priority to and incorporates by reference the entire contents of Japanese Patent Application No. 2011-241111 filed in Japan on Nov. 2, 2011.

BACKGROUND OF THE INVENTION

1. Field of the Invention

The present invention relates to a recording medium supplying device and an image forming apparatus.

2. Description of the Related Art

In image forming apparatuses such as copying machines, printers, facsimiles, or multifunction peripherals (MFPs) thereof, a sheet feeding device that supplies paper, an OHP film, or the like, one by one has been known. As the sheet feeding device, there is the following air separation sheet feeding device. That is, the air separation sheet feeding device blows air to pieces of paper in a bundle form that are mounted on a tray in a stacked state so as to make the pieces of paper (recording media) float and separate them from one another while flicking through the pieces of paper. Then, the air separation sheet feeding device makes paper at an uppermost position adsorb to an adsorption belt with a suction force and conveys the paper. As conventional air separation sheet feeding devices, there are air separation sheet feeding devices as disclosed in Japanese Patent Application Laid-open No. 2001-247229 and Japanese Patent Application Laid-open No. 2007-45630, for example.

FIG. 12 illustrates a schematic configuration of the above-described air separation sheet feeding device.

An air separation sheet feeding device 301 as illustrated in FIG. 12 includes a tray 302, a front blower 303 and a side blower 304, and an adsorption belt 305. A plurality of pieces of paper P are mounted on the tray 302. The front blower 303 and the side blower 304 blow air to upper front ends and upper side ends of the mounted pieces of paper P, respectively. The adsorption belt 305 adsorbs and conveys the mounted pieces of paper P one by one. Front end surfaces of the pieces of the paper P are made to hit a front fence 306 as a reference surface and are aligned so as to match with the size of the paper P on the tray 302.

The paper P is supplied on the air separation sheet feeding device 301 in the following manner. That is, air is blown onto a bundle of the pieces of paper P mounted on the tray 302 from the front blower 303 and the side blower 304, at first. With the air, the air is fed to between the pieces of paper P so as to make the pieces of paper P float to a height h of the adsorption belt 305 while flicking through the pieces of paper P. Then, paper P1 at an uppermost position is made to be adsorbed to the adsorption belt 305 among the floating pieces of paper. The adsorption belt 305 rotates in this state, so that the paper P1 is conveyed to an image forming unit (not illustrated) and image formation is performed.

Furthermore, each of the air separation sheet feeding devices as described in Japanese Patent Application Laid-open No. 2001-247229 and Japanese Patent Application Laid-open No. 2007-45630 includes an upper surface position detecting unit that detects a position of an uppermost surface of the mounted paper. As the upper surface position detecting unit, there is the following upper surface position detecting unit including an actuator 310 and a swing detecting sensor 311 as illustrated in FIG. 12, for example. The actuator 310 is configured to abut against an uppermost surface of a paper bundle and be capable of swinging. The swing detecting sensor 311 detects swinging of the actuator 310. An attachment position of the actuator 310 is provided in the vicinity of the adsorption belt 305 such that a desired distance h is continued to be kept with stable accuracy regardless of sizes of the paper P.

In this case, if the paper is supplied and the height of the paper bundle becomes lower, the actuator 310 swings therewith. Then, the swing detecting sensor 311 detects a swing amount of the actuator 310. A pushing-up unit (not illustrated) lifts a bottom plate of the tray 302 based on the detected signal, so that the height h (distance) from the upper surface of the paper bundle to the adsorption belt 305 is controlled to be constant.

On the actuator 310 of the upper surface position detecting unit as illustrated in FIG. 12, a roller 312 on a tip of the actuator 310 makes contact with the upper surface of the paper bundle with a constant pressing force all the time regardless of types of paper. However, in an image forming apparatus such as a copying machine, not only plain paper and recycled paper but also art paper and coat paper on which coating processing has been performed on surfaces thereof, no-carbon paper, and the like are available. Surfaces of these types of paper are easy to be scratched in comparison with the plain paper and the recycled paper. Therefore, a mark of the roller 312 is left with the pressing on the upper surface of the paper when the height of the paper is detected, resulting in deterioration of quality of output paper.

In particular, in a device in which a roller is separated temporarily from an upper surface of paper every time air is blown onto the paper, as described in Japanese Patent Application Laid-open No. 2011-73864, a collision force of the roller against the upper surface of the paper becomes larger and a mark of the roller is easy to be left on the paper when abutment and separation of the roller are repeated at high speed in order to convey the paper at high speed.

In order to solve the problem, it can be considered that the pressing force on the upper surface of the paper is set to be weaker. However, if the pressing force is set to be weaker, when rigid paper such as a cardboard is fed, an upward force with the rigidity of the paper overcomes the pressing force on the upper surface of the paper and there arises a risk that the upper surface position of the paper cannot be detected accurately. Moreover, when a hard cardboard is used, there arises a problem that collision noise is generated when the roller 312 on the tip of the actuator 310 abuts against the upper surface of the paper in some cases.

Therefore, there is a need to provide a recording medium supplying device that detects a height of paper reliably regardless of types of paper (types of recording medium) and conveys the paper reliably, and can prevent damage on the paper and generation of scratches and collision noise when the height of the paper is detected.

SUMMARY OF THE INVENTION

It is an object of the present invention to at least partially solve the problems in the conventional technology.

According to an aspect of the present invention, there is provided a recording medium supplying device including: a recording medium mounting portion on which sheet-like recording media are capable of being mounted in a stacked state; an air discharging unit that blows air to the recording media in the stacked state so as to make recording medium at an uppermost position float; a conveying unit that adsorbs and conveys the floating recording medium at the uppermost position; an upper surface position detecting unit that makes contact with an uppermost surface of the recording media in the stacked state and detects a height position of the uppermost surface; and a pressing force varying mechanism that makes a pressing force of the upper surface position detecting unit on the uppermost surface of the recording media variable.

According to another aspect of the present invention, there is provided an image forming apparatus including a recording medium supplying device, the recording medium supplying device including: a recording medium mounting portion on which sheet-like recording media are capable of being mounted in a stacked state; an air discharging unit that blows air to the recording media in the stacked state so as to make recording medium at an uppermost position float; a conveying unit that adsorbs and conveys the floating recording medium at the uppermost position; an upper surface position detecting unit that makes contact with an uppermost surface of the recording media in the stacked state and detects a height position of the uppermost surface; and a pressing force varying mechanism that makes a pressing force of the upper surface position detecting unit on the uppermost surface of the recording media variable.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
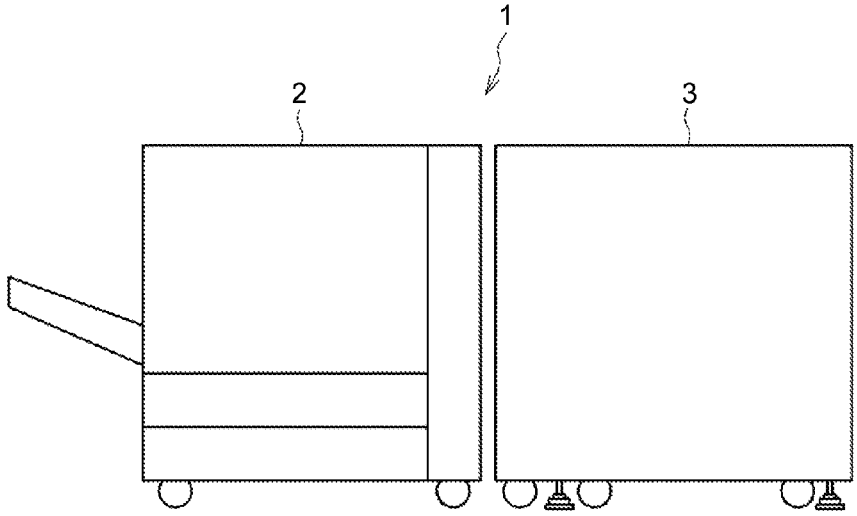
FIG. 1 is an external appearance view illustrating one mode for carrying out an image forming apparatus including a sheet feeding device according to embodiments.

Hereinafter, an embodiment of a recording medium supplying device according to the invention is described based on the accompanying drawings.

It is to be noted that in the drawings in order to explain the embodiment, the same reference numerals denote components of members, constituent parts, and the like, having the same function or shape as long as they can be identified and description that has been described once is omitted thereafter.

Image Forming Apparatus

FIG. 1 is an external appearance view illustrating one mode for carrying out the image forming apparatus including a sheet feeding device according to an embodiment of the invention.

As illustrated in FIG. 1, an image forming apparatus 1 includes an image forming apparatus main body 2 and a sheet feeding device 3. The sheet feeding device 3 is connected to one side surface of the image forming apparatus main body 2 and supplies paper to the image forming apparatus main body 2.

Figure 2:
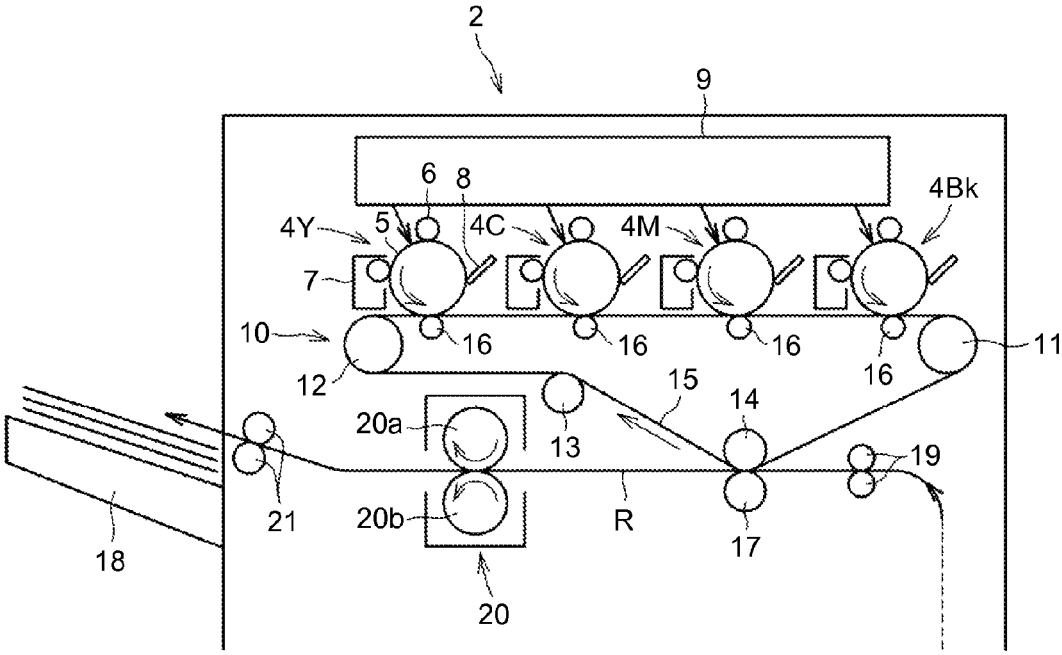
FIG. 2 is a schematic configuration view illustrating an image forming apparatus main body.

FIG. 2 is a schematic configuration view illustrating the image forming apparatus main body.

As illustrated in FIG. 2, the image forming apparatus main body 2 includes four process units 4Y, 4C, 4M, and 4Bk. The process units 4Y, 4C, 4M, and 4Bk are configured to be detachable from the image forming apparatus main body 2. The process units 4Y, 4C, 4M, and 4Bk have the same configuration other than a point that they house toner of different colors of yellow, cyan, magenta, and black corresponding to color separation components of a color image.

To be more specific, each of the process units 4Y, 4C, 4M, and 4Bk includes a photosensitive element 5 as an electrostatic latent image carrier, a roller charging device 6 as a charging unit, a developing device 7 as a developing unit, and a cleaning blade 8 as a cleaning unit. The roller charging device 6 charges a surface of the photosensitive element 5. The developing device 7 forms a toner image on a surface of the photosensitive element 5. The cleaning blade 8 cleans the surface of the photosensitive element 5.

In FIG. 2, an exposing device 9 as an exposing unit is arranged above the process units 4Y, 4C, 4M, and 4Bk. The exposing device 9 is configured so as to irradiate the photosensitive elements 5 of the process units 4Y, 4C, 4M, and 4Bk with laser beams.

A transfer device 10 is arranged below the process units 4Y, 4C, 4M, and 4Bk. The transfer device 10 has an intermediate transfer belt 15 formed by an endless belt wound around a plurality of rollers 11 to 14. If one of the rollers 11 to 14 rotates as a driving roller, the intermediate transfer belt 15 can move around in a direction as indicated by an arrow in FIG. 2.

Four primary transfer rollers 16 as primary transfer units are arranged at positions opposed to the four photosensitive elements 5. The primary transfer rollers 16 pressurize an inner circumferential surface of the intermediate transfer belt 15 at respective positions. Primary transfer nips are formed on places at which pressurized portions of the intermediate transfer belt 15 make contact with the photosensitive elements 5. Furthermore, a secondary transfer roller 17 as a secondary transfer unit is arranged at a position opposed to one roller 14 around which the intermediate transfer belt 15 is wound. The secondary transfer roller 17 pressurizes an outer circumferential surface of the intermediate transfer belt 15. A secondary transfer nip is formed on a place at which the secondary transfer roller 17 makes contact with the intermediate transfer belt 15.

A feed path R for guiding paper supplied from the sheet feeding device 3 to a discharge tray 18 provided at the outside of the device through the secondary transfer nip is arranged in the image forming apparatus main body 2. On the feed path R, timing rollers 19 are arranged at the upstream side with respect to the position of the secondary transfer roller 17 in the paper conveying direction. On the feed path R, a fixing device 20 is arranged at the downstream side with respect to the position of the secondary transfer roller 17 in the paper conveying direction. Furthermore, a pair of discharging rollers 21 are arranged at the downstream side with respect to the fixing device 20 in the paper conveying direction.

The fixing device 20 includes a heating roller 20*a* and a pressing roller 20*b*. The heating roller 20*a* has a heat source therein. The pressing roller 20*b* pressurizes the heating roller 20*a*. The heating roller 20*a* and the pressing roller 20*b* make contact with each other with a predetermined pressure so as to form a fixing nip on the contact portion therebetween.

Hereinafter, basic operations of the above-described image forming apparatus are described with reference to FIG. 2.

The photosensitive elements 5 of the process units 4Y, 4C, 4M, and 4Bk are driven rotationally in the counterclockwise direction in FIG. 2 and surfaces of the photosensitive elements 5 are charged to a predetermined polarity uniformly by the roller charging devices 6. Laser beams are applied to the changed surfaces of the photosensitive elements 5 from the exposing device 9 based on image information of a document scanned by a scanning device (not illustrated), so that electrostatic latent images are formed on the surfaces of the photosensitive elements 5. In this case, the image information to be exposed onto each photosensitive element 5 is single-color image information obtained by dividing a desired full-color image into color information of yellow, cyan, magenta, and black. Toner is supplied to the electrostatic latent images formed on the photosensitive elements 5 in the above manner by the developing devices 7, so that the electrostatic latent images are visualized as toner images.

One of the rollers that pressurize the intermediate transfer belt 15 is driven rotationally so as to make the intermediate transfer belt 15 move around in the direction as indicated by the arrow in FIG. 2. Furthermore, a constant voltage having opposite polarity to charged polarity of toner or a voltage at which current is controlled to be constant is applied to the primary transfer rollers 16. With this, transfer electric fields are formed on the primary transfer nips between the primary transfer rollers 16 and the photosensitive elements 5. Then, the toner images of the respective colors that have been formed on the photosensitive elements 5 are sequentially superimposed and transferred onto the intermediate transfer belt 15 with the transfer electric fields formed on the primary transfer nips.

In this manner, the intermediate transfer belt 15 carries a full-color toner image on the surface thereof. Furthermore, toner that has not been completely transferred onto the intermediate transfer belt 15 remains on the surfaces of the photosensitive elements 5 after transferring. The toner remaining on the photosensitive elements 5 is removed by the cleaning blades 8.

The paper is conveyed out from the sheet feeding device 3 as illustrated in FIG. 1 and the conveyed paper is fed to the secondary transfer nip between the secondary transfer roller 17 and the intermediate transfer belt 15 at the timing manipulated by the timing rollers 19. At this time, a transfer voltage having opposite polarity to toner charged polarity of the toner images on the intermediate transfer belt 15 is applied to the secondary transfer roller 17. With this, a transfer electric field is formed on the secondary transfer nip. Then, the toner images on the intermediate transfer belt 15 are transferred onto the paper correlatively with the transfer electric field formed on the secondary transfer nip.

The paper onto which the toner images have been transferred is conveyed to the fixing device 20. The paper is nipped between the heating roller 20*a* and the pressing roller 20*b* in the fixing device 20 and is heated and pressurized. With this, the toner images are fixed onto the paper. Thereafter, the paper is discharged to the discharge tray 18 by the pair of discharging rollers 21.

An image forming operation when a full-color image is formed on the paper has been described above. However, a single-color image can be formed by using any one of the four process units 4Y, 4C, 4M, and 4Bk, or a two-color or three-color image can be formed by using two or three process units.

Sheet Feeding Device

Figure 3:
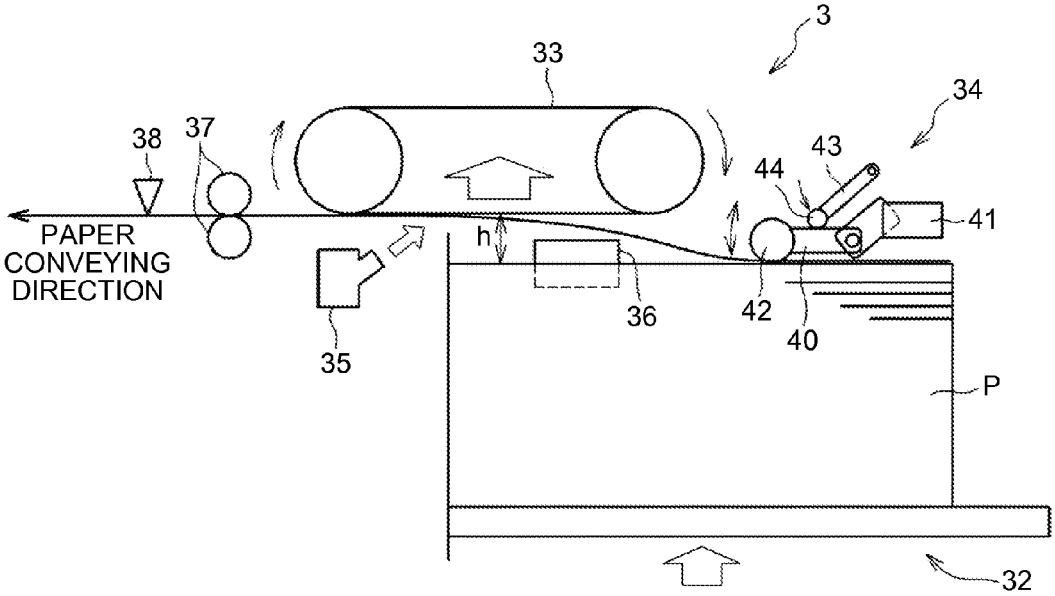
FIG. 3 is a schematic configuration view illustrating the entire sheet feeding device.

Next, a configuration of the sheet feeding device according to the embodiment of the recording medium supplying device of the invention is described based on FIG. 3 to FIG. 11. FIG. 3 is a schematic configuration view illustrating the entire sheet feeding device 3. The sheet feeding device 3 as illustrated in FIG. 3 includes a paper feed tray 32 as a recording medium mounting portion, an adsorption belt 33 as a conveying unit, an upper surface position detecting device 34 as an upper surface position detecting unit, a pushing-up unit (not illustrated), a front blower 35 and side blowers 36 as air discharging units, a pair of carriage rollers 37, and a paper detecting sensor 38. A plurality of pieces of paper P can be mounted on the paper feed tray 32 in a stacked state. The adsorption belt 33 conveys the paper. The upper surface position detecting device 34 detects an upper surface position of a mounted paper bundle. The pushing-up unit raises a height of an upper surface of the paper bundle to a predetermined height based on a detected result of the upper surface position detecting device 34. The front blower 35 and the side blowers 36 blow air to the mounted paper bundle and make one piece of paper at an uppermost position float. The carriage rollers 37 are arranged at the downstream side with respect to the adsorption belt 33 in the paper conveying direction. The paper detecting sensor 38 is arranged at the further downstream side.

The upper surface position detecting device 34 includes an actuator 40, a photo sensor 41, a pressing roller 42 as a pressing member, and a biasing lever 43 and a biasing roller 44 as biasing units. The "biasing unit" indicates a unit that makes an elastic force act. Details of the upper surface position detecting device 34 will be described later.

The paper feed tray 32 is configured so as to be taken out to the front side by opening a front door (not illustrated) of the sheet feeding device 3. Furthermore, paper can be exchanged or replenished on the paper feed tray 32 in a state where the paper feed tray 32 is taken out of the sheet feeding device 3. The paper P that can be mounted on the paper feed tray 32 includes a cardboard, a postcard, an envelope, plain paper, thin paper, coated paper (coat paper, art paper, and the like), and tracing paper. The sheet feeding device according to the embodiment of the invention is configured so as to supply an OHP sheet, an OHP film, and the like as sheet-like recording media other than paper.

Figure 4:
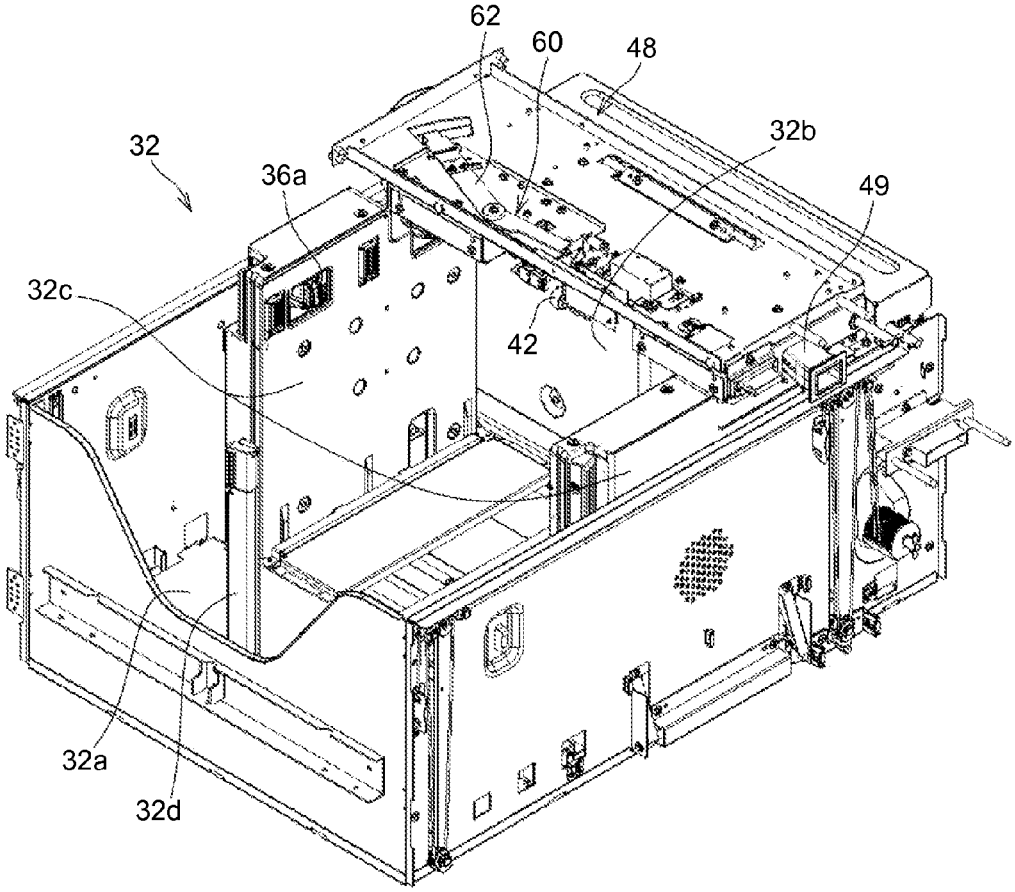
FIG. 4 is a perspective view illustrating an inner configuration of the sheet feeding device.

FIG. 4 is a perspective view illustrating an inner configuration of the sheet feeding device according to the invention.

As illustrated in FIG. 4, the paper feed tray 32 as the recording medium mounting portion forms a box shape of which upper side is opened. The paper feed tray 32 includes a bottom plate 32*a*, a front fence 32*b*, a pair of side fences 32*c*, and an end fence 32*d*. The front fence 32*b* positions a front end of the paper bundle mounted on the bottom plate 32*a* in the conveying direction. The side fences 32*c* position both ends of the paper bundle in the width direction (direction orthogonal to the conveying direction). The end fence 32*d* positions a rear end of the paper bundle in the conveying direction. The paper is exchanged or replenished from the upper side of the paper feed tray 32.

An adsorption belt unit 48 having the above-described adsorption belt 33 and the like is attached to the upper side of the paper feed tray 32 at the side of the front fence 32*b*. Note that the adsorption belt unit 48 is attached in such a form that the adsorption belt unit 48 gets across the upper side of the paper feed tray 32 in the width direction (direction perpendicular to a paper plane in FIG. 3). A suction duct 49 is connected to the adsorption belt unit 48.

Figure 5:
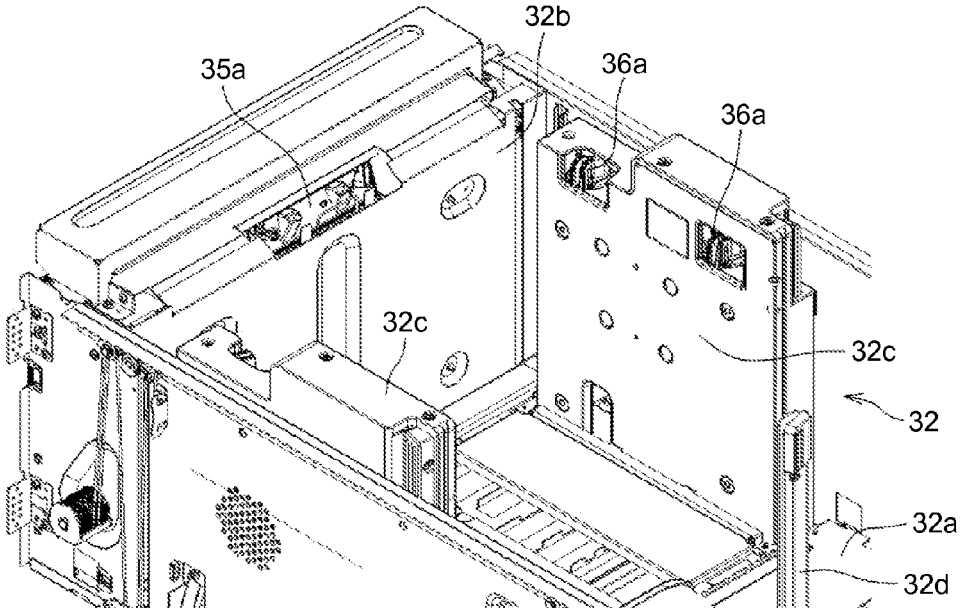
FIG. 5 is a perspective view illustrating the inner configuration of the sheet feeding device.

FIG. 5 illustrates the sheet feeding device of FIG. 4 in a state where the adsorption belt unit 48 is detached.

As illustrated in FIG. 5, one front air discharging port 35*a*is arranged in the vicinity of an upper portion of the front fence 32*b*. A pair of side air discharging ports 36*a* and 36*a* are provided to respective upper portions of the two side fences 32*c*. The discharging ports 35*a* and 36*a* are connected to the blowers (front blower 35, side blowers 36) arranged in the respective fences through ducts (not illustrated). The air discharged from the discharging ports 35*a* and 36*a* is blown onto an upper layer of the paper bundle mounted on the paper feed tray 32.

Figure 6:
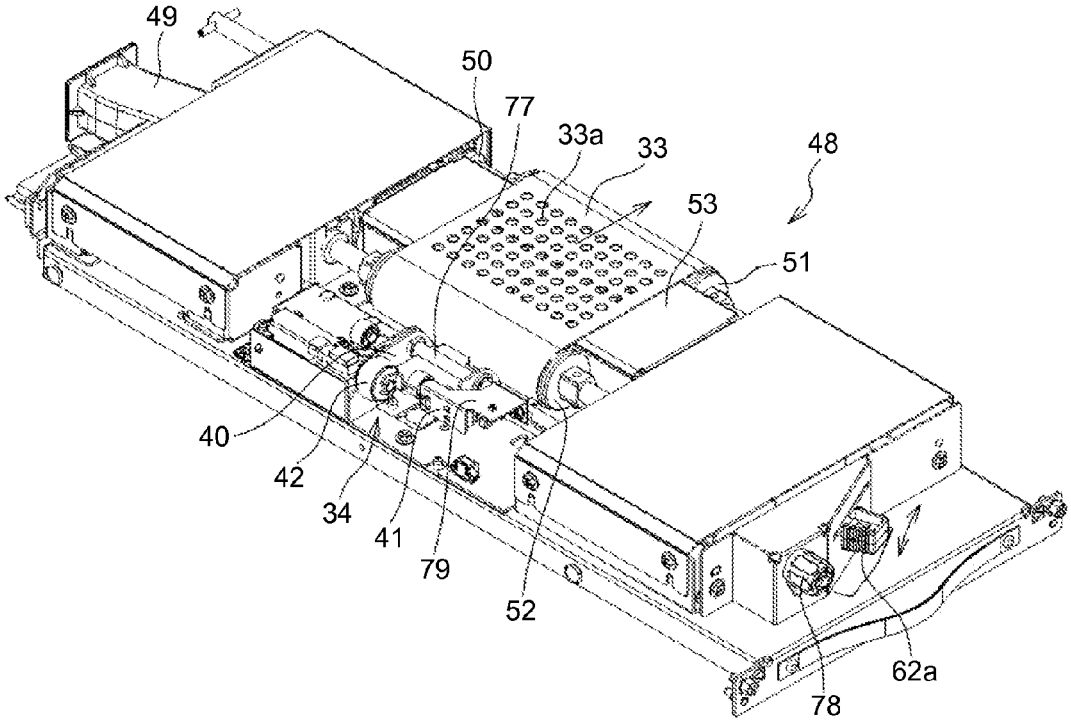
FIG. 6 is a perspective view illustrating an adsorption belt unit when seen from the lower side.

FIG. 6 is a perspective view illustrating the adsorption belt unit 48 as illustrated in FIG. 4 when seen from the lower side. As illustrated in FIG. 6, the adsorption belt unit 48 includes the adsorption belt 33, a driving motor 50 as a driving unit, the suction duct 49, and the above-described upper surface position detecting device 34. The driving motor 50 drives the adsorption belt 33 rotationally. The suction duct 49 connects the adsorption belt unit 48 to a suction blower (not illustrated).

The adsorption belt 33 is bridged between a driving roller 51 and a driven roller 52 in a state where a predetermined tensile force is applied. The driving motor 50 is coupled to the driving roller 51. If the driving motor 50 is driven at a predetermined feeding timing, the driving roller 51 is driven rotationally and the adsorption belt 33 rotates in an arrow direction.

A box-shaped suction chamber 53 is provided to a region surrounded by the adsorption belt 33 between the driving roller 51 and the driven roller 52. An opening of which lower end (upper end in FIG. 6) is opened is formed on the suction chamber 53. The suction chamber 53 is connected to the suction blower (not illustrated) through the suction duct 49. If the suction blower (not illustrated) is driven and the air is sucked from the suction chamber 53 through the suction duct 49, an inner portion of the suction chamber 53 becomes at a negative pressure. With this, the air is sucked from a plurality of suction ports 33*a* formed on the adsorption belt 33 and the paper is adsorbed to a lower surface of the adsorption belt 33 with the sucked air.

Figure 7:
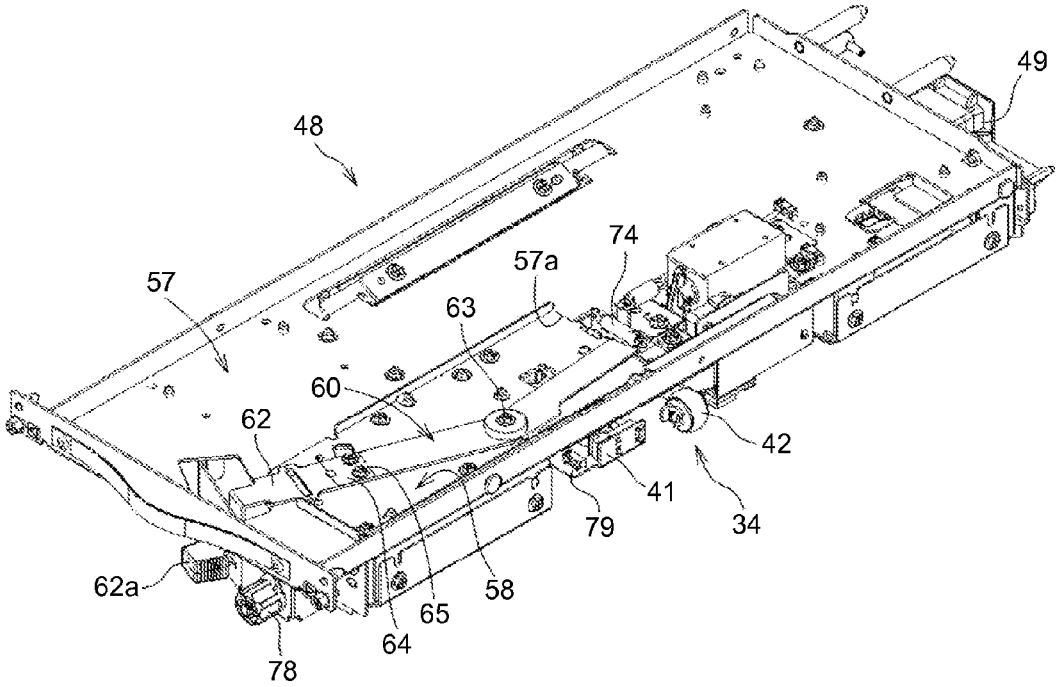
FIG. 7 is a perspective view illustrating the adsorption belt unit when seen from the above.
Figure 8A:
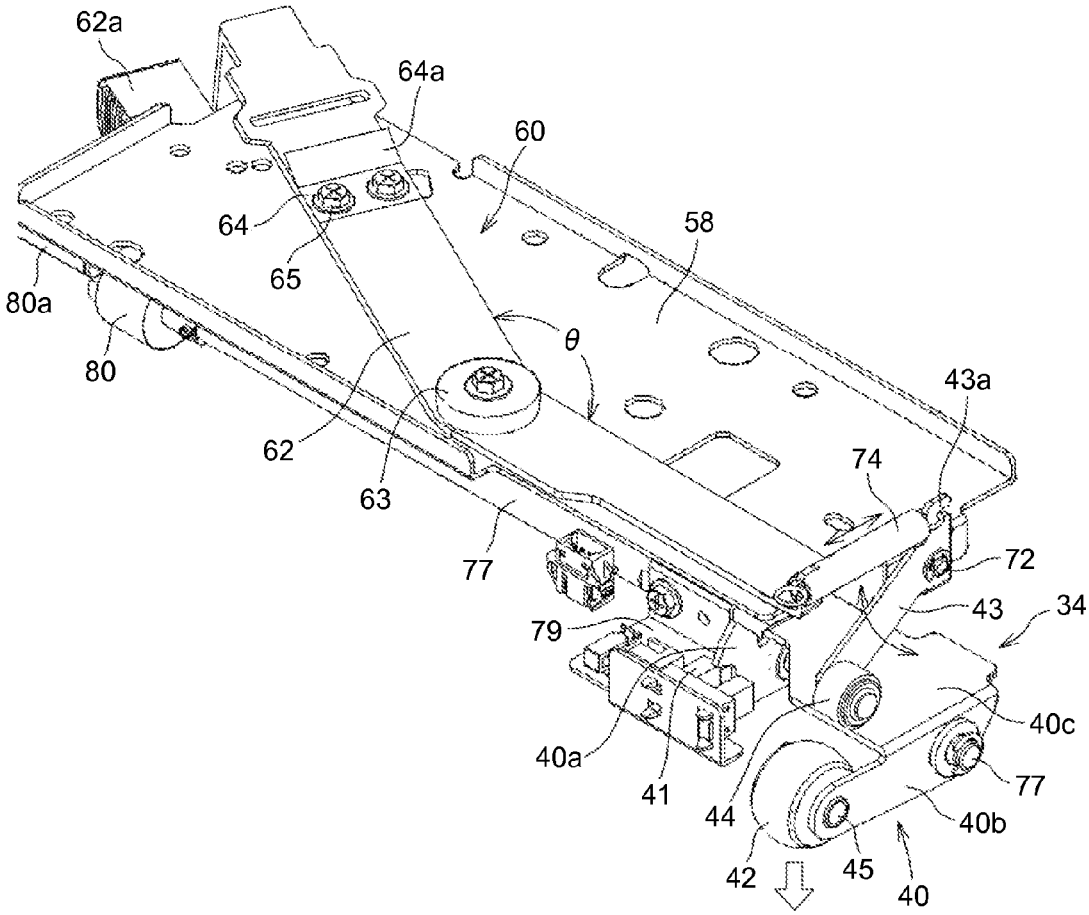
FIG. 8A is a perspective view illustrating a pressing force varying mechanism provided to the adsorption belt unit when seen from the above in a state where a pressing force is set to be large.
Figure 8B:
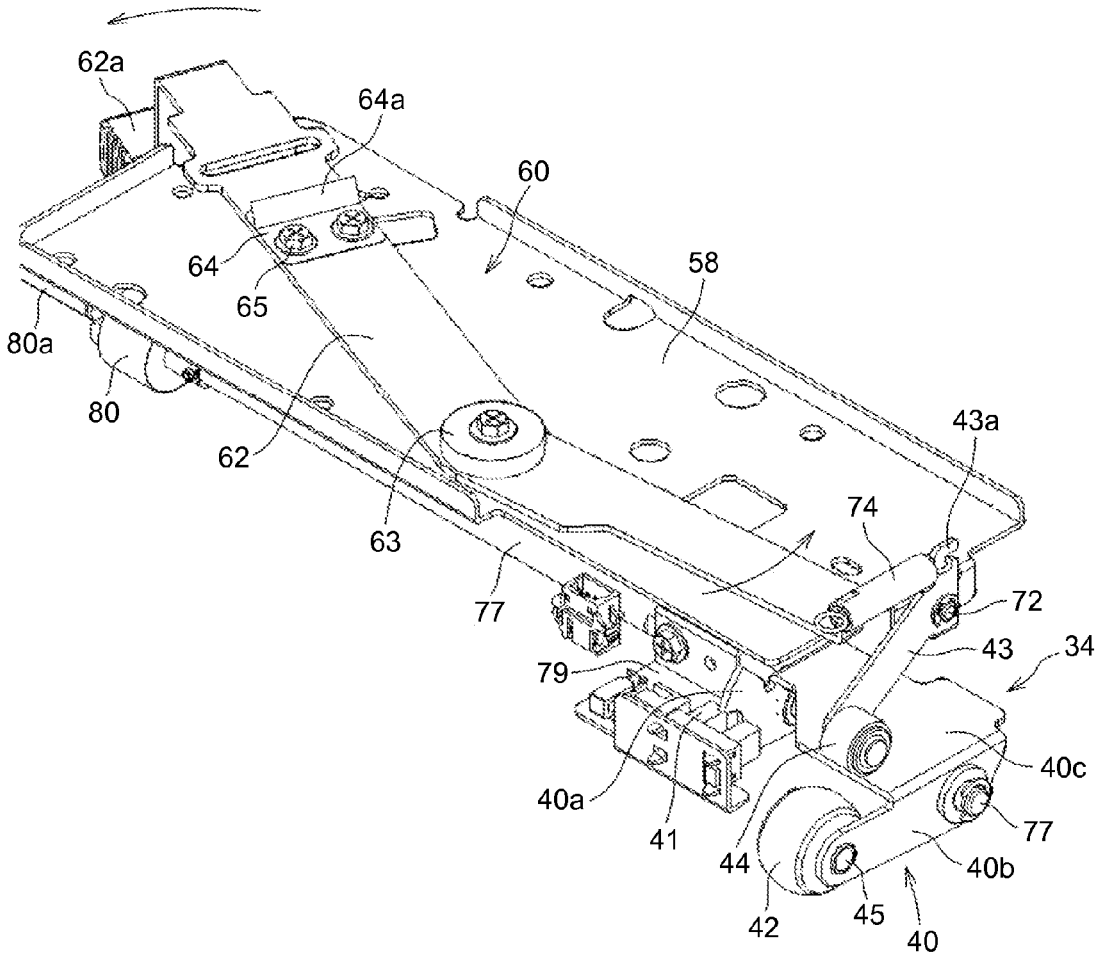
FIG. 8B is a perspective view illustrating the pressing force varying mechanism provided to the adsorption belt unit when seen from the above in a state where the pressing force is set to be small.

A rotating shaft 77 is arranged next to the driven roller 52 of the adsorption belt 33 so as to be in parallel with the driven roller 52. The actuator 40, which will be described later, is attached to one end of the rotating shaft 77 in a rotationally movable manner. The other end of the rotating shaft 77 is coupled to a polygonal columnar grip 78 through a torque limiter 80 and a shaft portion 80*a* thereof as illustrated in FIG. 8A and FIG. 8B. The grip 78 is arranged at an access side (side of a front surface of the sheet feeding device 3) of a first supporting member 57 as illustrated in FIG. 6 and FIG. 7. If the grip 78 is rotated in the clockwise direction, a position of the photo sensor 41, which will be described later, can be made lower. On the other hand, if the grip 78 is rotated in the counterclockwise direction, the position of the photo sensor 41 can be made higher.

FIG. 7 is a perspective view illustrating the adsorption belt unit 48 in FIG. 4 when seen from the above. As is seen from FIG. 7, the adsorption belt unit 48 includes the first supporting member 57 and a second supporting member 58. The first supporting member 57 is a main body of the unit and has a horizontal rectangular plate shape. The second supporting member 58 is smaller than the first supporting member 57. The first and second supporting members 57 and 58 are separated mainly in order to make assembly easy. These two supporting members 57 and 58 can be formed as one integrated supporting member. The second supporting member 58 is formed by a sheet metal and is attached in a cutout 57*a* with a plurality of screws. The cutout 57*a* is formed on a front-side portion of the first supporting member 57 so as to have a substantially equal size to the second supporting member 58.

As illustrated in FIG. 8A and FIG. 8B, the upper surface position detecting device 34 and a pressing force varying mechanism 60 are arranged on the above-described second supporting member 58. The pressing force varying mechanism 60 makes a pressing force of the upper surface position detecting device 34 variable. The pressing force varying mechanism 60 is an example and it is needless to say that the pressing force varying mechanism 60 can be replaced by a varying mechanism other than that as illustrated in FIG. 8A and FIG. 8B. It is to be noted that since the adsorption belt 33 is arranged at the lower side of the adsorption belt unit 48, the adsorption belt 33 cannot be visually recognized in FIG. 7 while being hidden by the first supporting member 57 and the second supporting member 58.

As is seen from FIG. 7, the second supporting member 58 has a length that is a substantially half of the first supporting member 57, for example, and a rear end portion of the second supporting member 58 is located at a substantially center of the first supporting member 57 in the lengthwise direction. As illustrated in FIG. 8A and FIG. 8B, a plate-like operating lever 62 is arranged on the second supporting member 58 along the lengthwise direction thereof. The operating lever 62 is bent at a substantially center portion with an obtuse angle θ of approximately 160°, for example. The bent portion is supported on the second supporting member 58 through a support shaft 63 as a supporting portion in a rotationally movable manner. A front end portion of the operating lever 62 extends to an end of the first supporting member 57 at the access side (side of the front surface of the sheet feeding device 3) and is bent to the lower side in a crank form. An operating unit 62*a* made of a resin is attached to an end of the bent portion in the crank form. Furthermore, a positional relationship in which the above-described grip 78 is arranged at a right adjacent position to the operating unit 62*a* is satisfied.

Figure 10A:
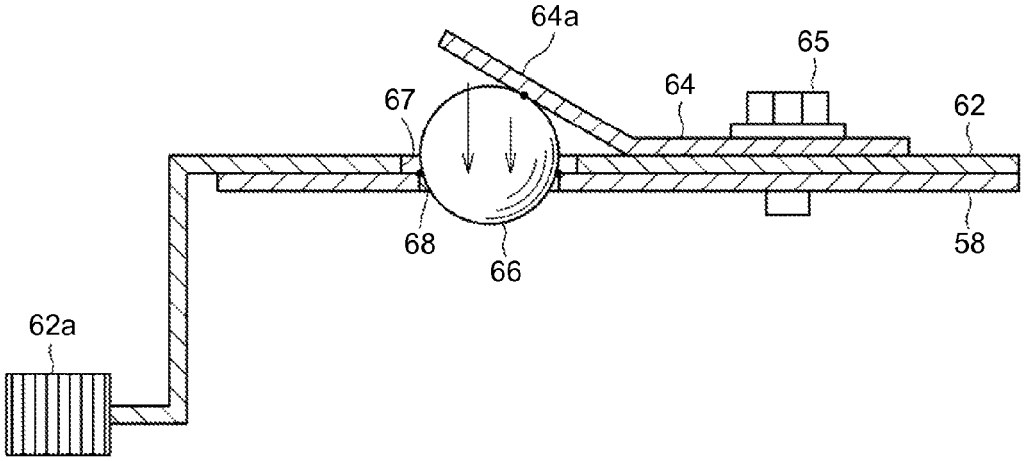
FIG. 10A is a side surface view when an operating lever is fixed.
Figure 10B:
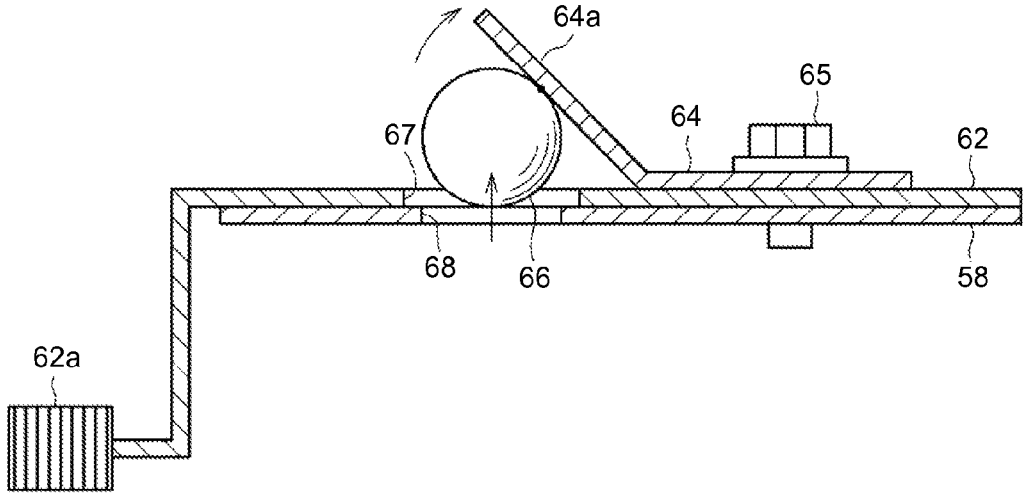
FIG. 10B is a side surface view when the operating lever is moved rotationally.

A spring material as an elastic member, in the embodiment, a rectangular plate spring 64 is attached to an upper surface of the operating lever 62 at the front side with respect to the support shaft 63 with two screws 65. To be more specific, the front side of the plate spring 64 is bent to the obliquely upper side as illustrated in FIGS. 10A and 10B. A spherical body 66 is attached to a lower surface of a bent portion 64*a* by welding, adhesion, or the like.

One upper through-hole 67 is formed on the operating lever 62 at the lower side of the bent portion 64*a* of the plate spring 64. The upper through-hole 67 has such a size that the spherical body 66 can pass therethrough and has a diameter that is smaller than approximately 1.1times as a diameter of the spherical body 66, for example. Furthermore, a plurality of lower through-holes 68 are formed on the second supporting member 58 at the lower side of the operating lever 62 at an equivalent interval. The lower through-holes 68 are formed so as to correspond to a rotational movement locus of the upper through-hole 67 when the operating lever 62 moves rotationally about the support shaft 63. The lower through-holes 68 are circular through-holes having diameters (approximately 90% of the diameter of the spherical body, for example) smaller than the diameter of the spherical body 66.

If the operating lever 62 is moved rotationally to a predetermined position, a substantially lower half of the spherical body 66 is fitted into any one of the lower through-holes 68 (outer circumferential surface of the spherical body 66 makes linear contact with the lower through-hole 68). As illustrated in FIG. 10A, the rotational movement of the operating lever 62 about the support shaft 63 is locked through the spherical body 66. That is to say, a locking mechanism of the operating lever 62 is constituted by the plate spring 64, the spherical body 66, and the upper and lower through-holes 67 and 68.

When a rotational movement position of the operating lever 62 is desired to be changed, the operating unit 62*a* of the operating lever 62 is pressed strongly to the right side or the left side in the horizontal direction. If the operating unit 62*a* is pressed in this manner, as illustrated in FIG. 10B, the spherical body 66 escapes from the lower through-hole 68 against a pushing-down force of the bent portion 64*a* of the plate spring 64. With this, rotational movement of the operating lever 62 while sliding the spherical body 66 on the upper surface of the second supporting member 58 can be realized. Then, if the spherical body 66 is moved to a position of another adjacent lower through-hole 68, the spherical body 66 is fitted into the lower through-hole 68 with the pushing-down force of the bent portion 64*a* of the plate spring 64.

The operating unit 62*a* is located at the access side (side of the front surface of the sheet feeding device 3) of the first supporting member 57, that is, at the front end portion of the paper feed tray 32. Therefore, the operating unit 62*a* can be operated easily without taking the paper feed tray 32 out of the device main body. In the embodiment, the operating lever 62 is locked or positioned in a phased manner. However, it is needless to say that the operating lever 62 can be made to be positioned in a non-phase manner by attaching a torque limiter to the support shaft 63 instead of the plate spring 64, the spherical body 66, and the upper and lower through-holes 67 and 68, for example.

As illustrated in FIG. 8A and FIG. 8B, the plate-like biasing lever 43 is provided at the rear side of the second supporting member 58. A portion of the biasing lever 43 in the vicinity of an upper end thereof is supported on a support shaft 72 as a fulcrum provided at a rear end portion of the second supporting member 58 in a rotationally movable manner. With this, the biasing lever 43 is rotationally movable about the support shaft 72 in the up-down direction. As is seen from FIG. 9, the support shaft 72 is arranged at the upper side of the rotating shaft 77 so as to be separated therefrom by a predetermined distance D. A lower end portion of the biasing lever 43 extends to the obliquely lower side and the biasing roller 44 is attached to a tip of the lower end portion in a rotationally movable manner.

Figure 9:
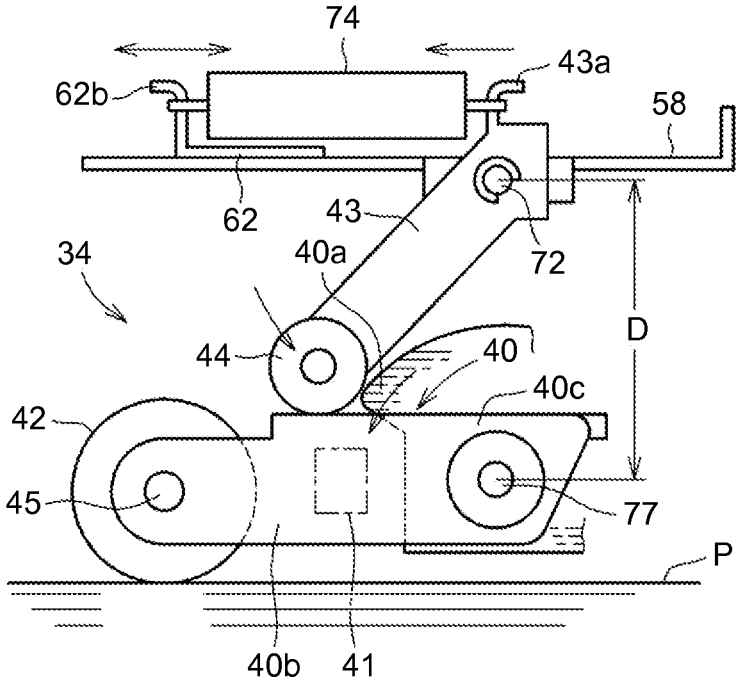
FIG. 9 is a side surface view illustrating the pressing force varying mechanism.

An L-shaped spring hooking portion 43*a* is formed on an upper end portion of the biasing lever 43, as illustrated in FIG. 9. One end of a tensile spring 74 as an elastic member is hooked and locked on the spring hooking portion 43*a*. The other end of the tensile spring 74 is hooked and locked on an L-shaped spring hooking portion 62*b* formed on a rear end portion of the operating lever 62. That is to say, the other end of the tensile spring 74 is supported on the first supporting member 57 through the operating lever 62 and the support shaft 63 thereof in such a manner that a position thereof can be changed. Accordingly, the biasing lever 43 is biased by the tensile spring 74 in the counterclockwise direction in a rotational movement manner all the time in FIG. 8A and FIG. 8B.

The tensile spring 74 is an example of an elastic member and it is needless to say that the tensile spring 74 can be replaced by another elastic member. For example, a torsion spring can be used as the elastic member by deforming the pressing force varying mechanism 60. The torsion spring can be arranged around the support shaft 72, for example. Furthermore, a configuration in which one end of the torsion spring is hooked and locked on the biasing lever 43 and the other end thereof is coupled to a rotating operation member, for example, can be employed.

The above-described rotating shaft 77 is restricted from being freely moved rotationally with a binding force of the torque limiter 80. As the torque limiter 80, for example, a well-known coil spring system or powder system can be used. The grip 78 is a member for moving the rotating shaft 77 rotationally in a non-phase manner against the torque limiter 80. It is to be noted that a locking member for locking a rotational movement position in a non-phase manner may be provided instead of the torque limiter 80.

The above-described actuator 40 is attached to the rear end portion of the rotating shaft 77 in a rotationally movable manner. Furthermore, the integrated photo sensor 41 is attached to the rotating shaft 77 in the vicinity of the actuator 40 through a bracket 79. A light projecting portion and a light receiving portion are arranged so as to be opposed to each other in the photo sensor 41. The photo sensor 41 is a member for detecting a rotational movement position of the actuator 40 and it is needless to say that the photo sensor 41 can be replaced by another sensor having equivalent functions regardless of a contact type or a non-contact type.

The actuator 40 is formed by bending a sheet metal into a gate form (portal form). A plate-like filler 40*a* is formed at one side of the actuator 40. Furthermore, the light projecting portion and the light receiving portion of the photo sensor 41 are arranged so as to sandwich the filler 40*a* from both sides. Whether the actuator 40 reaches a predetermined rotational movement position can be detected by the photo sensor 41. An arm portion 40*b* extending horizontally is formed at the other side of the actuator 40. The pressing roller 42 for pressurizing the uppermost surface of the paper is attached to a tip of the arm portion 40*b* with a support shaft 45 in a rotationally movable manner. The pressing roller 42 is located at a substantially center of the paper feed tray 32 in the width direction and the support shaft 45 thereof is directed to a direction orthogonal to the feeding direction.

The filler 40*a* and the arm portion 40*b* of the actuator 40 are coupled to each other with a coupling plate portion 40*c* that is substantially horizontal. As illustrated in FIG. 8A, FIG. 8B and FIG. 9, the biasing roller 44 makes contact with an upper surface of the coupling plate portion 40*c* with a predetermined contact pressure. Accordingly, the actuator 40 is biased in the counterclockwise direction about the rotating shaft 77 in FIG. 9 with a biasing force of the biasing roller 44. The pressing roller 42 applies a predetermined pressing force to a substantially center of the uppermost surface of the paper in the width direction.

In the embodiment, the actuator 40 is not biased directly by the tensile spring 74 but is biased indirectly through the biasing lever 43 and the biasing roller 44. This configuration is employed in order to reduce a biasing force of the tensile spring 74 largely with a lever ratio of the biasing lever 43 about the support shaft 72 so as to make the tensile spring 74 having a relatively large spring constant available. With this, a necessary pressing force can be changed with a small rotational movement amount of the operating lever 62. Furthermore, if the spring constant of the tensile spring 74 is made larger, a spring space (the number of turns and spring diameter) can be reduced and manufacturing cost can be reduced.

If the paper is supplied and the upper surface position (height) of the paper bundle becomes lower in a state where the pressing roller 42 makes contact with the upper surface of the paper bundle, the actuator 40 swings about the rotating shaft 77 therewith. Then, the photo sensor 41 detects displacement of the filler 40*a* with the swinging of the actuator 40. Furthermore, the pushing-up unit (not illustrated) lifts the bottom plate 32*a* of the bottom plate 32*a* based on the detected signal of the photo sensor 41, so that a height h (see, FIG. 3) from the upper surface of the paper bundle to the adsorption belt 33 is kept to be a predetermined height.

Figure 11A:
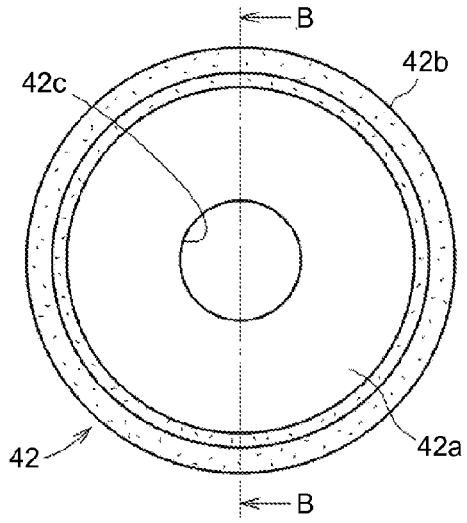
FIG. 11A is a side surface view illustrating a pressing roller.
Figure 11B:
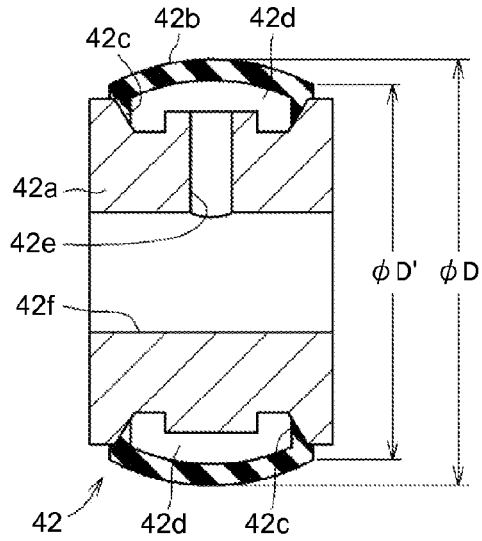
FIG. 11B is a cross-sectional view cut along a line B-B in FIG. 11A.
Figure 12:
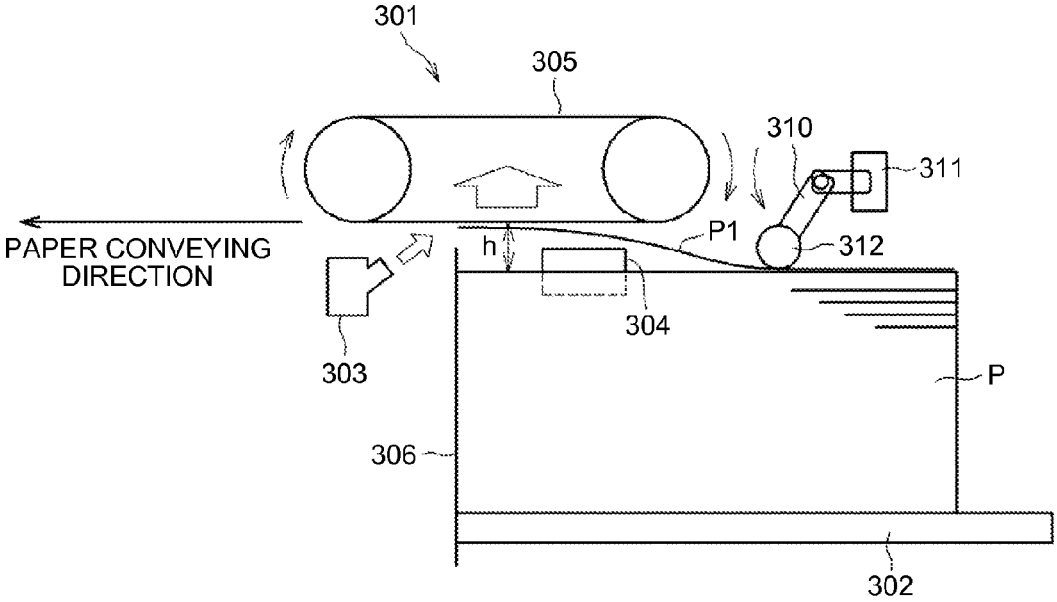
FIG.12 Conventional Art
FIG. 12 is a schematic configuration view illustrating a conventional air separation sheet feeding device.

As illustrated in FIGS. 11A and 11B, the pressing roller 42 includes a hollow cylindrical core 42*a* made of a resin and a cylindrical pressing portion 42*b* made of rubber as an elastic member. The pressing portion 42*b* is fitted into an outer circumference of the core 42*a*. It is needless to say that the pressing portion 42*b* can be replaced by an elastic member other than the rubber.

Peripheral portions of the pressing portion 42*b* at both of right and left ends are fitted into circular grooves 42*c*. The circular grooves 42*c* are formed on outer circumferential surfaces of the core 42*a*. The center of the pressing portion 42*b* in the width direction expands to the outer side in the radial direction in a circular-arc form. With this, the pressing roller 42 has a larger diameter at the center in the width direction than those at both sides of the roller in the width direction ($\phi D' < \phi D$). Furthermore, the pressing portion 42*b* has elasticity at an appropriate degree with a void portion 42*d* formed at the inner side (at least inner side of the portion having the large diameter at the center in the width direction) of the pressing portion 42*b*.

It is to be noted that the void portion 42*d* can be made continuous to a bore portion 42*f* by forming a hole portion 42*e* on the core 42*a* in the radial direction if needed. With this, the air is allowed to enter and exit with respect to the void portion 42*d* through the hole portion 42*e*, so that the pressing portion 42*b* is easy to be deformed elastically.

The pressing roller 42 is made to have a hollow configuration by the void portion 42*d* or the bore portion 42*f*. Therefore, light-weight and reduction in cost by reducing materials can be realized. It is needless to say that the hole portion 42*e* also contributes to the light-weight and the reduction in materials. It is to be noted that the bore portion 42*f* is a hole into which the support shaft 45 of the pressing roller 42 is inserted, as illustrated in FIG. 9.

In this manner, the pressing roller 42 is molded into such a shape that an outer diameter thereof is gradually smaller from the center to both sides in the width direction. Therefore, a contact area of the pressing roller 42 with the paper can be made smaller so as to reduce damage on the paper and make a range in which scratches are generated smaller. Furthermore, the pressing portion 42*b* has elasticity at the appropriate degree. Therefore, paper can be fed through without deteriorating paper quality when non-carbon paper or the like of which surface is easy to be scratched is output. This makes it possible to enhance paper availability as the device.

Feeding Operation

Next, a feeding operation (feeding method) of the sheet feeding device is described.

If a feeding instruction is issued from the image forming apparatus main body, air is blown onto upper-layer paper of the mounted paper bundle from the blowers (front blower 35 and side blowers 36) and air suction of the adsorption belt 33 is started at the same time. With this, first paper at the uppermost position of the paper bundle is made to float to the height h of the adsorption belt 33 while separating the first paper from second and subsequent pieces of paper and is adsorbed to the lower surface of the adsorption belt 33. Then, rotation of the adsorption belt 33 and the carriage rollers 37 is started to convey the first paper in a state where the first paper is adsorbed to the adsorption belt 33.

Thereafter, if the first paper reaches and is detected by the paper detecting sensor 38 in FIG. 3, the rotation of the adsorption belt 33 is stopped. The carriage rollers 37 continue to convey the paper in a state where the adsorption belt 33 is stopped. The pressing roller 42 of the actuator 40 makes contact with an upper surface of the second paper and detects an upper surface position of the paper bundle. As a result of the detection of the upper surface position of the paper bundle, if the upper surface position is lower than a predetermined reference height, the bottom plate 32*a* of the paper feed tray 32 is lifted by the pushing-up unit (not illustrated). With this, the height h (distance) from the upper surface of the paper bundle to the adsorption belt 33 is adjusted to a predetermined value. Furthermore, when the detected upper surface position of the paper bundle is not lower than the predetermined reference height, the height is not adjusted.

Increasing and Decreasing Operations of Paper Pressing Force

Next, increasing and decreasing operations of a paper pressing force are described.

To convey normal paper (plain paper), the operating lever 62 is used at a position in FIG. 8A. To convey a recording medium that can be easily damaged, such as art paper or coat paper on which coating processing has been performed on a surface thereof, non-carbon paper or an OHP film, the following operation is performed: the operating unit 62*a* of the operating lever 62 is held by a hand and the operating lever 62 is moved rotationally in the counterclockwise direction in FIG. 8A and FIG. 9 so as to be moved rotationally to the position in FIG. 8B. Note that the operating unit 62*a* of the operating lever 62 is located at the access side (side of the front surface of the sheet feeding device 3) of the first supporting member 57, that is, at the front end portion of the paper feed tray 32. The operating unit 62*a* can therefore be operated easily without taking the paper feed tray 32 out of the device main body.

If the operating lever 62 is moved rotationally in the counterclockwise direction in this manner, the front end side of the operating lever 62 is moved in the direction of loosening the tensile spring 74 (right direction in FIG. 8B). Therefore, the biasing force of the biasing lever 43 is lowered. Accordingly, an abutting pressure against the actuator 40 by the biasing roller 44 is lowered and a pressing force on the paper by the pressing roller 42 is lowered. Therefore, even if the pressing roller 42 abuts against the recording medium that is easy to be scratched, the recording medium can be prevented from being damaged. In addition, a material, a shape, and a configuration of the above-described pressing roller 42 ensure to prevent the recording medium from being damaged more reliably.

To convey the recording medium that is difficult to be scratched and has high rigidity, such as a cardboard, if the pressing force of the pressing roller 42 is weak, the strength of the rigidity of the recording medium overcomes the pressing force of the pressing roller 42. Therefore, in this case, the pressing force of the pressing roller 42 is increased. That is to say, in order to increase the pressing force on the paper, the operating unit 62*a* of the operating lever 62 is held by a hand and the operating lever 62 is moved rotationally in the clockwise direction in FIG. 8A and FIG. 9.

With this, the tensile spring 74 is pulled by the operating lever 62 more strongly, the abutting force against the actuator 40 by the biasing roller 44 of the biasing lever 43 is increased, and the pressing force on the upper surface of the recording medium by the pressing roller 42 is increased. Therefore, a pressing force that is not overcome by the strength of the rigidity of the recording medium such as a cardboard is obtained. As a result, accurate detection of the upper surface position of the paper and accurate conveyance of the recording medium with the accurate detection can be realized.

Furthermore, the material, the shape, and the configuration of the above-described pressing roller 42 exhibit an effect of suppressing collision noise from being generated when the pressing roller 42 abuts against the recording medium having strong rigidity. In addition, the collision noise can be also suppressed from being generated by adjusting the pressing force on the paper by the pressing roller 42 with the operating lever 62. Height Adjustment of Paper Upper Surface Position Next, adjustment of the height h of the paper upper surface position is described.

As described in the feeding operation, when the upper surface position of the paper bundle is lower than the predetermined reference height, the height is adjusted such that the height h (distance) from the upper surface of the paper bundle to the adsorption belt 33 becomes a predetermined value by lifting the bottom plate 32*a* of the paper feed tray 32. Whether the upper surface position of the paper bundle is lower than the predetermined reference height is determined by checking whether the filler 40*a* of the actuator 40 to which the pressing roller 42 is attached shields light of the photo sensor 41.

If the paper bundle upper surface position becomes lowered, the light shielding portion of the filler 40*a* as illustrated in FIG. 9 becomes lowered with the rotational movement of the actuator 40 about the rotating shaft 77 in the counterclockwise direction. Then, the bottom plate 32*a*of the paper feed tray 32 is started to be lifted by the pushing-up unit at the height of the pressing roller 42 when the light shielding portion shields an optical axis of the photo sensor 41. That is to say, the pushing-up unit receives a signal from the photo sensor 41 and lifts the bottom plate 32*a* of the paper feed tray 32, so that the adjustment of the height is started. If the light shielding portion of the filler 40*a* goes up and light from the light projecting portion of the photo sensor 41 reaches the light receiving portion again with the adjustment of the height, the adjustment of the height is finished (height h becomes the predetermined value).

In a common sheet feeding device, the height h from the upper surface of the paper bundle to the adsorption belt 33 is constant. However, if the height h is constant, there is a problem when thin paper or a cardboard that is different from plain paper is conveyed. Specifically, to convey the thin paper, the paper at the uppermost position is difficult to be separated from paper at the lower side thereof and a plurality of pieces of paper are adsorbed to the adsorption belt 33 as a bundle of the pieces of paper and conveyed (multi-fed) as they are in some cases. To convey paper having a large weighing ($g/m^2$) such as a cardboard, it takes much time for the paper to be adsorbed to the adsorption belt 33. Therefore, the paper is not adsorbed to the adsorption belt 33 and non-feeding occurs in some cases. In the embodiment, the height h can be adjusted to be made higher or lower by rotating the grip 78 in accordance with types of paper to be conveyed.

Specifically, to convey thin paper, the grip 78 is rotated by a necessary predetermined amount in the clockwise direction in FIG. 7. With this, the rotating shaft 77 coupled to the grip 78 is rotated in the same direction, so that the position of the photo sensor 41 is made lower. When the bottom plate 32*a* of the paper feed tray 32 is lifted by the pushing-up unit, the light shielding portion of the filler 40*a* becomes earlier to escape from the optical axis of the photo sensor 41 by the lowered amount. As a result, the time it takes the bottom plate 32*a* of the paper feed tray 32 to be lifted by the pushing-up unit becomes shorter and the height h is increased, so that the thin paper is separated reliably.

To convey a cardboard, the grip 78 is rotated by a necessary predetermined amount in the counterclockwise direction in FIG. 7. With this, the rotating shaft 77 coupled to the grip 78 is rotated in the same direction, so that the position of the photo sensor 41 is made higher. When the bottom plate 32*a* of the paper feed tray 32 is lifted by the pushing-up unit, the light shielding portion of the filler 40*a* delays to escape from the optical axis of the photo sensor 41 by the heightened amount. As a result, the time it takes the bottom plate 32*a* of the paper feed tray 32 to be lifted by the pushing-up unit becomes longer and the height h is decreased, so that a recording medium having a large weighing such as the cardboard is adsorbed to the adsorption belt 33 reliably.

In both cases of the thin paper and the cardboard, rotation of the grip 78 can be adjusted in a non-phase manner. Therefore, the height h of the upper surface of the paper can be finely adjusted and the paper can be fed normally regardless of weighing from the thin paper to the cardboard. This makes it possible to enhance paper availability. The grip 78 is located at the access side (side of the front surface of the sheet feeding device 3) of the first supporting member 57, that is, at the front end portion of the paper feed tray 32. Therefore, the height h of the upper surface of the paper can be adjusted easily without taking the paper feed tray 32 out of the device main body. The adjustment of the height h of the paper upper surface position can be performed as described above.

As described above, the embodiment of the invention has been described. However, the invention is not limited to the above-described embodiment and it is needless to say that various changes can be added in a range without departing from a scope of the invention. Furthermore, the sheet feeding device (recording medium supplying device) according to the invention is not limited to be provided to a color-image forming apparatus as illustrated in FIG. 1. The sheet feeding device (recording medium supplying device) according to the invention can be also provided to a monochrome-image forming apparatus, other copying machines, printers, facsimiles, MFPs having these functions, and the like.

According to the aspect of the embodiments, the pressing force varying mechanism that makes a pressing force of the upper surface position detecting unit on an uppermost surface of the recording media variable is provided. Therefore, when a recording medium that is easy to be scratched is used, the recording medium can be prevented from being damaged by making the pressing force smaller. Alternatively, when a hard recording medium is used, collision noise can be also prevented from being generated by making the pressing force smaller.

Furthermore, when a recording medium having large rigidity is used, the pressing force is increased so as to overcome the strength of the rigidity. With this, an upper surface position of the recording media can be detected accurately and the recording medium can be conveyed reliably therewith.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording medium supplying device, comprising:

a recording medium mounting portion on which sheet-like recording media are capable of being mounted in a stacked state;

an air discharging unit that blows air to the recording media in the stacked state so as to make recording medium at an uppermost position float;

a conveying unit that adsorbs and conveys the floating recording medium at the uppermost position;

an upper surface position detecting unit that makes contact with an uppermost surface of the recording media in the stacked state and detects a height position of the uppermost surface, the upper surface position detecting unit includes:

an actuator that is supported on a supporting member arranged above the recording medium mounting portion in a rotationally movable manner, a pressing member that is attached to a tip of the actuator and makes contact with the uppermost surface of the recording media, and a biasing unit that biases the tip of the actuator to the lower side; and a pressing force varying mechanism that makes a pressing force of the upper surface position detecting unit on the uppermost surface of the recording media variable, wherein the biasing unit includes an elastic member, and one end of the elastic member is supported on the supporting member through the pressing force varying mechanism and the other end of the elastic member is coupled to the actuator, the elastic member is formed by a spring, and the pressing force varying mechanism includes:

an operating lever that extends in a width direction of the supporting member, one end of the operating lever being coupled to the spring and the other end forming an operating unit at an access side of the supporting member;

a supporting portion that supports an intermediate portion of the operating lever on the supporting member in a rotationally movable manner, and a locking mechanism that locks the operating lever at a set rotational movement position.

2. The recording medium supplying device according to claim 1, wherein the biasing unit includes:

a biasing lever that is biased by the spring and is rotationally movable about a fulcrum separated from a rotating shaft of the actuator, and a biasing roller that is attached to a tip of the biasing lever and biases the actuator.

3. The recording medium supplying device according to claim 2, wherein the pressing member is formed by a pressing roller, and the pressing roller is made to have a larger diameter at center in the width direction of the roller than diameters at both sides in the width direction.

4. The recording medium supplying device according to claim 3, wherein an outer circumference of the pressing roller is formed by an elastic member, and a void portion is formed on the elastic member at the inner side of the portion having the larger diameter at the center in the width direction.

5. An image forming apparatus comprising a recording medium supplying device, the recording medium supplying device comprising:

a recording medium mounting portion on which sheet-like recording media are capable of being mounted in a stacked state;

an air discharging unit that blows air to the recording media in the stacked state so as to make recording medium at an uppermost position float;

a conveying unit that adsorbs and conveys the floating recording medium at the uppermost position;

an upper surface position detecting unit that makes contact with an uppermost surface of the recording media in the stacked state and detects a height position of the uppermost surface, the upper surface position detecting unit includes:

an actuator that is supported on a supporting member arranged above the recording medium mounting portion in a rotationally movable manner, a pressing member that is attached to a tip of the actuator and makes contact with the uppermost surface of the recording media, and a biasing unit that biases the tip of the actuator to the lower side; and a pressing force varying mechanism that makes a pressing force of the upper surface position detecting unit on the uppermost surface of the recording media variable, wherein the biasing unit includes an elastic member, and one end of the elastic member is supported on the supporting member through the pressing force varying mechanism and the other end of the elastic member is coupled to the actuator, the elastic member is formed by a spring, and the pressing force varying mechanism includes:

an operating lever that extends in a width direction of the supporting member, one end of the operating lever being coupled to the spring and the other end forming an operating unit at an access side of the supporting member;

a supporting portion that supports an intermediate portion of the operating lever on the supporting member in a rotationally movable manner, and a locking mechanism that locks the operating lever at a set rotational movement position.

6. The image forming apparatus according to claim 5, wherein the biasing unit includes:

a biasing lever that is biased by the spring and is rotationally movable about a fulcrum separated from a rotating shaft of the actuator, and a biasing roller that is attached to a tip of the biasing lever and biases the actuator.

7. The image forming apparatus according to claim 6, wherein the pressing member is formed by a pressing roller, and the pressing roller is made to have a larger diameter at center in the width direction of the roller than diameters at both sides in the width direction.

8. The image forming apparatus according to claim 7, wherein an outer circumference of the pressing roller is formed by an elastic member, and a void portion is formed on the elastic member at the inner side of the portion having the larger diameter at the center in the width direction.

* * * * *